United States Patent [19]

Davies et al.

[11] 4,410,441

[45] Oct. 18, 1983

[54] PRODUCT FOR TREATING FABRICS IN A WASHING MACHINE

[75] Inventors: James F. Davies, Wirral; John B. Tune, Higher Bebington, both of England

[73] Assignee: Lever Brothers Company, New York, N.Y.

[21] Appl. No.: 371,646

[22] Filed: Apr. 26, 1982

[51] Int. Cl.[3] ..... C11D 17/00

[52] U.S. Cl. ..... 206/0.5; 252/92; 252/93; 252/90; 428/245; 383/1; 383/38; 383/102; 383/93; 383/94

[58] Field of Search ..... 252/90, 92, 93; 206/0.5; 150/3; 428/245

[56] References Cited

U.S. PATENT DOCUMENTS

| | | | |
|---|---|---|---|
| 4,082,678 | 4/1978 | Pracht et al. | 252/8.6 |
| 4,139,475 | 2/1979 | Schwadtke et al. | 252/8.6 |
| 4,188,304 | 2/1980 | Clarke et al. | 252/93 |
| 4,234,442 | 11/1980 | Cornelissens | 252/90 |

FOREIGN PATENT DOCUMENTS

| | | |
|---|---|---|
| 1578951 | 11/1980 | United Kingdom . |
| 2000177 | 1/1982 | United Kingdom . |

*Primary Examiner*—John E. Kittle
*Assistant Examiner*—Hoa Van Le
*Attorney, Agent, or Firm*—Milton L. Honig; James J. Farrell

[57] ABSTRACT

A fabric treatment product is in the form of a bag having at least two compartments containing particulate fabric treatment compositions. The bag has a first outer wall and an intermediate wall of water-insoluble but water-permeable material such as paper or nonwoven fabric, and a second outer wall of water-impermeable water-insoluble plastics sheet. In the washing machine the wash water first enters the compartment bounded by the first outer wall, which is water-permeable, and dissolves or disperses out its contents, for example, a detergent composition. The water subsequently penetrates the intermediate wall to enter the second compartment and dissolve or disperse out its contents, for example, a fabric conditioner.

8 Claims, 2 Drawing Figures

PRODUCT FOR TREATING FABRICS IN A WASHING MACHINE

Figure 1:
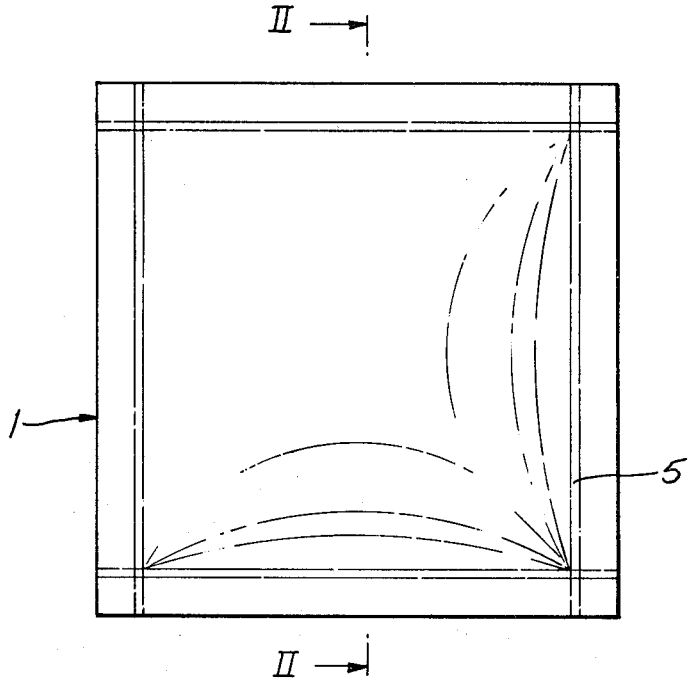

This invention relates to fabric treatment products which are suitable for treating fabrics in a washing machine and which contain fabric treatment materials such as detergent compositions in particulate form.

Although the marketing of particulate detergent compositions packaged in cartons is common practice, this imposes constraints both on their formulation and methods of production. For example the compositions must be free flowing and have an attractive appearance to the consumer, and the ingredients should not segregate during transport and storage. The products must also be safe, both for contact with the skin and in the event of accidental ingestion; in particular, the compositions should not contain too high a level of alkaline material, although alkalinity is beneficial for detergent properties.

When using washing machines which have a rotating drum in which the fabrics are placed, there can also be substantial losses of conventionally dosed detergent powder by retention in the dispenser and by its accumulation in the dead spaces beneath the drum, such as the drain hose.

In U.S. Pat. No. 4,188,304 (Clarke et al) there are described fabric treatment products which comprise particulate detergent compositions contained within a closed water-insoluble sachet of fibrous material with a water-sensitive seal, whereby the contents of the sachet are discharged on contact with water. These products give consumer benefits both by way of improved efficiency in the use of the detergent compositions and in greater convenience of use. Further fabric treatment products in sachet form are disclosed in International Applications Nos. W080/01076Al, W080/01077Al, W080/01078Al and W080/01079Al (Unilever).

GB No. 2,000,177 (Akzo) discloses two-compartment detergent sachets. In one construction described, the sachet has two water-permeable outer walls, for example, of nonwoven fabric, and a water-insoluble water-impermeable internal partition. An alternative construction is also described in which one compartment is bounded wholly by walls consisting of water-permeable, water-soluble, or water-disintegrable materials; for example, the sachet may have a first water-permeable-outer wall, a second water-impermeable outer wall, and an internal partition that disintegrates above a certain temperature.

U.S. Pat. No. 4,139,475 (Schwadtke et al) relates to a laundry finishing treatment agent in sachet form, for use in a tumble-dryer. The sachet has two compartments, and has one outer wall of impermeable material, another of slitted polyethylene film, and an internal partition of material, for example, polyethylene film, impermeable to perfume oil at ambient temperature but permeable thereto at the elevated temperature of the tumble-dryer. The compartment bounded by the slit wall contains a fabric conditioner and the other, closed, compartment contains a fleece impregnated with perfume oil.

According to the present invention there is provided a fabric treatment product in the form of a bag having at least two compartments and having a first outer wall formed of water-permeable water-insoluble material, a second outer wall formed of water-impermeable water-insoluble synthetic plastics material, and at least one intermediate wall formed of water-insoluble material, said first and second outer walls bounding different compartments within the bag, said compartments containing particulate fabric treatment compositions.

The invention furthermore provides a fabric treatment product in the form of a bag having two compartments and having a first outer wall formed of water-permeable water-insoluble material and bounding a first compartment of the bag; a second outer wall formed of water-impermeable water-insoluble synthetic plastics material and bounding a second compartment of the bag; an intermediate wall formed of water-permeable water-insoluble material and dividing the bag into said first and said second compartments; said first and said second compartments containing the same or different particulate fabric treatment compositions.

The first outer wall of the bag should be sufficiently water-permeable so that, in use, water can enter the bag to disperse the contents of the first compartment into the water in the washing machine. It should not have a pore size so high that dusting of the fabric treatment material from the bag occurs to an unacceptable extent.

The first outer wall is advantageously formed of fibrous sheet material, a suitable material being water-permeable paper or woven, knitted or especially nonwoven fabric of high wet-strength, weighing about 5 to 100 g/m$^2$, preferably 10 to 60 g/m$^2$, especially about 15 to 40 g/m$^2$, such as is commonly used for packaging beverage powders and other foodstuffs. Suitable sheet materials of this type are commercially available, for example wet-strength paper from J. R. Crompton Brothers Limited, of Bury, England.

The fibres preferably used for the sheet material of the first outer wall may be of natural or synthetic origin and may be used alone or in admixture, for example polyamide, polyester, polyacrylic, cellulose acetate, polyethylene, polypropylene, polyvinyl chloride, polyvinylidene chloride or cellulosic fibres. If cellulose fibres are used, it may be desirable to include a proportion of long fibres such as Manila hemp, in order to improve the strength of the sheet material, impart pliability, and reduce stiffness, thereby giving the material a fabric-like appearance/texture. A binder may also be necessary for increasing wet-strength. It is preferred to include at least a proportion of thermoplastic fibres, for increasing resistance to chemical attack by any of the ingredients of the fabric treatment material.

The intermediate wall may be formed of the same or different material as the first outer wall. Advantageously it may be less porous, or may be coated or laminated with a water-removable material, that is to say, a water-soluble or water-insoluble but water-dispersible material, in order to increase the delay in the dissolution of the component in the second compartment.

The water-impermeable water-insoluble material of the second outer wall is preferably a synthetic plastics material film which may be formed from a thermoplastic material and in this case is advantageously selected from films of polyolefins such as polyethylene, polypropylene, polystyrene; polyesters especially polyethyleneterephthalate; vinyl polymers such as insoluble polyvinylacetate, polyvinylacrylate, polyvinylchloride, polyvinylidene chloride; polyamides and polyacrylonitrile and other synthetic plastics film material having similar physical properties.

The bags may be closed by a variety of methods, such as the use of water-insoluble adhesives, heat-sealing, cold pressure or cold contact sealing or mechanical sealing. It is advisable that the bags are closed in such a manner that they do not open in use. When an adhesive is used, it may be necessary to treat the bag material to accept the adhesive, for example, by surface oxidation (corona discharge).

Heat-sealing is particularly applicable where both outer walls of the bag are formed by a thermoplastic material and, preferably though not essentially, the intermediate wall is also formed of a thermoplastic material.

The bags can be formed from three separate sheets of material sealed together at the edges or from a single folded sheet of water-permeable material formed into a tubular section with a further sheet of water-impermeable material bounded thereto at the edges.

In use, the bag is placed in the drum or tub of a washing machine together with the soiled fabric load and water is allowed into the machine. The water initially enters the bag through the first outer wall (the permeable wall) and dissolves or disperses the contents of the first compartment. Subsequently the water enters the second compartment through the permeable intermediate wall and dissolves or disperses the contents thereof. There is thus a delay between the discharge of the contents of the first compartment and the discharge of the contents of the second compartment. The relationship between the porosity of the first outer wall and that of the intermediate wall determines the delay between the discharge of the fabric treatment material components in the respective compartments of the bag into the water in the drum or tub of the washing machine. As previously mentioned, this delay is further controlled when the permeable intermediate wall is coated or laminated with a water-soluble or dispersible water-insoluble material.

Where the two compartments contain the same fabric treatment material this delay can be utilised to provide a long term discharge of material into the liquor.

More usually, however, the two compartments will contain different components or mixtures of components and the discharge of the contents of one of the compartments into the water in the drum or tub of the washing machine is delayed.

A further advantage of the present invention is that it enables components of a fully formulated detergent composition which are difficult to incorporate together in a product due to physical or chemical incompatibility, to be kept separate until use.

The fabric treatment material represented by the contents of the two compartments may be a fully formulated detergent composition.

As an alternative to fully formulated detergent compositions (that is a composition containing at least a surfactant and a builder) the bags may contain any one or more of the following fabric treatment materials: bleaches such as sodium perborate; bleach precursors such as tetraacetylethylene diamine (TAED); fabric softeners such as quaternary ammonium compounds; starch; perfumes; antibacterial agents; antistatic agents; whitening or blueing agents; anti-incrustation agents; enzymes; stain-removing agents and the like. It can be of particular advantage if a fully formulated detergent composition is contained in the first compartment while the second compartment contains for example a fabric treatment material selected from perfumes, bleaches, bleach precursors, anti-incrustation agents and fabric conditioning agents.

The fully formulated compositions which can be packaged to advantage in the products of the invention are amply described in the literature, for example in "Surface Active Agents and Detergents", Volumes I and II, by Schwartz, Perry and Berch.

However, because when the products of the invention are used powder processing and appearance are less critical, they can be used to especial advantage for detergent powders containing insoluble ingredients. Specific examples of such ingredients include finely-divided calcium carbonate, the use of which is described in GB No. 1 437 950 (Unilever), and sodium aluminosilicate ion-exchange materials as described in GB No. 1 429 143 (Procter & Gamble) and in GB Nos. 1 473 210 and 1 473 202 (Henkel).

It is also advantageous to use the products of this invention with detergent compositions containing bleach systems, particularly containing TAED and sodium perborate.

In addition, the products of the invention are particularly suited for particulate detergent compositions of relatively high bulk density, that is to say, over about 0.5 g/cc, preferably about 0.6 to 0.8 g/cc, up to a maximum of about 1 g/cc, above which there tends to be a reduction in the rate of water solubility or dispersibility. The use of high bulk density compositions makes it possible to use relatively small detergent bags which still contain enough particulate detergent composition to be fully effective during use. This also enables the use of simple processing techniques for the production of the detergent compositions themselves, for example, granulation or dry mixing, instead of traditional spray drying techniques.

The particle size distribution of the fabric treatment material should preferably be selected in relation to the pore size distribution of the fibrous sheet material constituting the first outer wall of the bag, so that no more than about 5% by weight, preferably no more than about 1%, of the particles can pass through the fibrous material in the dry state, and hence cause dusting. For retaining powders, for example, powders made by dry mixing, the material of the first outer bag wall should preferably be made from fibrous material having a very small maximum pore size so as to allow only detergent particles less than about 20 microns to dust from the bag on handling or in transit. For retaining coarser grained powders the first outer wall should preferably be made from sheet material having a maximum pore size such as to allow only detergent particles less than about 100 microns to dust from the bag. Similarly the porosity of the intermediate wall should be such as to allow only minimal passage of components between compartments, or, as previously mentioned, it may be coated with a water-soluble or water-dispersible material to retain the powder in the inner compartment.

If desired, the outer walls of the bag can be marked or tagged so that it can easily be recognised amongst the washed fabrics, for example the material may be printed with a simulated fabric pattern such as check or gingham.

Figure 2:
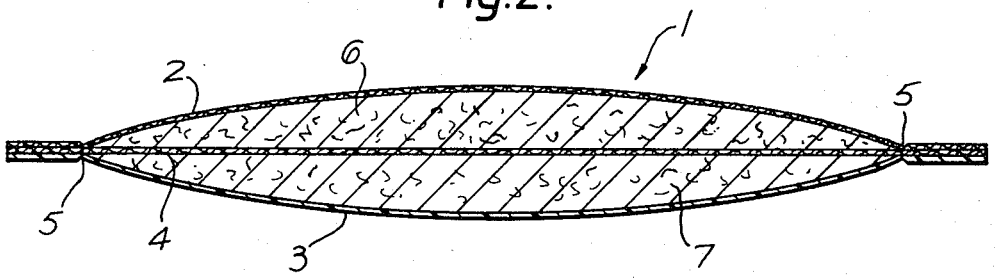

The invention will now be described in more detail, by way of example only, with reference to the accompanying drawings, in which FIG. 1 represents a schematic plan view of a product according to the invention, and FIG. 2 represents a section, on a larger scale, along the line II—II of FIG. 1.

Referring now to FIGS. 1 and 2 of the accompanying drawings, a bag 1 is formed of three square sheets of sheet material 2, 3, 4 each approximately $4\frac{1}{2}'' \times 4\frac{1}{2}''$. A first outer sheet 2 is of acrylic-bonded polyester/viscose nonwoven fabric having a base weight of 33 g/m$^2$ and a second outer sheet 3 is of polyethylene film having a base weight of 45 g/m$^2$. An intermediate sheet 4 is of thermally bonded polypropylene nonwoven fabric having a base weight of 36 g/m$^2$. The three sheets are joined together by heat-sealing 5 close to and parallel to their edges, the heat-sealing being carried out at a temperature and pressure selected to create a non-opening seal. Sheets 2 and 4 bound a first compartment 6 containing a particulate fabric treatment composition, and sheets 3 and 4 bound a second compartment 7 containing a particulate fabric treatment composition which may be the same as or different from that in the first compartment 6.

The product 1 is manufactured by heat-sealing the three sheets 2, 3 and 4 together along three of their four sides. The compartments are then filled with the appropriate particulate fabric treatment compositions and the bag is closed by heat-sealing the three sheets together along the fourth side.

The following non-limiting Example illustrates the invention.

EXAMPLE

A bag as described above with reference to the accompanying drawings was produced by heat-sealing along three sides. The first compartment was then filled with 67 g of a particulate detergent composition made up as follows:

| Ingredient | parts by weight |
|---|---|
| Nonionic detergent compound ($C_{12}$-$C_{15}$ alcohol - 8 EO) | 15 |
| Sodium carbonate | 35 |
| Calcite (80 m$^2$/g ex Solvay) | 20 |
| Sodium tallow/coconut 80/20 soap | 4 |
| SCMC, fluorescent agents, perfume and minor ingredients | 2 |
| Water (water of hydration of sodium carbonate) | 4 |

and the second compartment was filled with 17 g of granular sodium perborate tetrahydrate.

The bags were then used to wash soiled fabric loads together with detergency and bleaching monitors in front-loading automatic washing machines, by placing the bags inside the drums with the loads and monitors. The machines were programmed for a hot wash cycle. Good detergency results and enhanced bleaching were obtained owing to the fact that the alkaline detergent composition was discharged first into the water in the drum of the washing machine, to cause a rise in pH early in the wash sufficient to commence deactivation of catalase from the soil before release of the sodium perborate into the wash liquor, so that decomposition of the sodium perborate by the catalase and loss of bleaching thereby was reduced.

We claim:

1. A fabric treatment product in the form of a bag, treatment being in a washing machine, the bag having two compartments and having a first outer wall formed of water-permeable water-insoluble material and bounding a first compartment of the bag; a second outer wall formed of water-impermeable water-insoluble synthetic plastics material and bounding a second compartment of the bag; an intermediate wall formed of water-permeable water-insoluble material and dividing the bag into said first and second compartments; said first and said second compartments containing the same or different particulate fabric treatment compositions.

2. The fabric treatment product of claim 1, wherein one of said first and second compartments contains a particulate detergent composition and the other of said first and second compartments contains one or more fabric treatment compositions selected from the group consisting of detergent compositions, perfumes, bleaches, bleach precursors, fabric conditioning agents and anti-incrustation agents.

3. A fabric treatment product in the form of a bag, treatment being in a washing machine, the bag having at least two compartments and having a first outer wall formed of water-permeable water-insoluble material whose maximum pore size is less than about 100 microns, a second outer wall formed of water-impermeable water-insoluble synthetic plastics material, and at least one intermediate wall formed of water-permeable water-insoluble material, said first and second outer walls bounding different compartments within the bag, said compartments containing particulate fabric treatment compositions.

4. The product of claim 3, wherein said water-impermeable water-insoluble synthetic plastics sheet material of said second outer wall comprises thermoplastic material.

5. The product of claim 4, wherein both said outer walls comprise thermoplastic materials and the bag is closed by heat-sealing.

6. The product of claim 3, wherein said water-insoluble water-permeable sheet material of said first outer wall comprises paper or woven, knitted or nonwoven fabric.

7. The product of claim 3, wherein said intermediate wall is coated or laminated with a water-soluble or water-dispersible material.

8. The product of claim 3, wherein at least one of said compartments contains a fabric treatment composition including calcium carbonate, sodium aluminosilicate ion-exchange materials or mixtures thereof.

* * * * *